US010172471B2

(12) United States Patent
Zerhusen

(10) Patent No.: US 10,172,471 B2
(45) Date of Patent: Jan. 8, 2019

(54) SIDERAIL WITH STORAGE AREA

(71) Applicant: Hill-Rom Services, Inc., Batesville, IN (US)

(72) Inventor: Robert M. Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 321 days.

(21) Appl. No.: 14/991,156

(22) Filed: Jan. 8, 2016

(65) Prior Publication Data

US 2016/0120329 A1 May 5, 2016

Related U.S. Application Data

(63) Continuation of application No. 12/546,756, filed on Aug. 25, 2009, now Pat. No. 9,259,371, which is a continuation-in-part of application No. 12/534,889, filed on Aug. 4, 2009, now Pat. No. 9,072,638.

(51) Int. Cl.

| | |
|---|---|
| ***A47C 21/08*** | (2006.01) |
| ***A61G 7/05*** | (2006.01) |
| ***B65D 8/00*** | (2006.01) |
| ***A47C 31/00*** | (2006.01) |

(52) U.S. Cl.

CPC ..... *A47C 21/08* (2013.01); *A47C 31/00* (2013.01); *A61G 7/0507* (2013.01); *A61G 7/0509* (2016.11); *A61G 7/0514* (2016.11); *A61G 7/0524* (2016.11); *B65D 15/00* (2013.01); *Y10T 29/49718* (2015.01)

(58) Field of Classification Search

CPC ..... A61G 7/05; A61G 7/0503; A61G 7/0507; A61G 2007/0524; A47C 21/00; A47C 21/08; A47C 31/00

USPC ..... 5/425, 503.1, 658

See application file for complete search history.

(56) References Cited

U.S. PATENT DOCUMENTS

| | | | | |
|---|---|---|---|---|
| 6,486,792 | B1 * | 11/2002 | Moster | A47C 31/008 297/411.2 |
| 6,781,517 | B2 * | 8/2004 | Moster | A47C 31/008 297/411.2 |
| 9,259,371 | B2 * | 2/2016 | Zerhusen | A61G 7/0507 |
| 2003/0076238 | A1 * | 4/2003 | Moster | A47C 31/008 340/4.11 |
| 2005/0007258 | A1 * | 1/2005 | Moster | A47C 31/008 340/4.12 |
| 2011/0010851 | A1 * | 1/2011 | Zerhusen | A61G 7/0507 5/425 |
| 2011/0010853 | A1 * | 1/2011 | Howell | A61G 7/0507 5/425 |
| 2011/0010854 | A1 * | 1/2011 | Zerhusen | A61G 7/0507 5/425 |
| 2013/0146601 | A1 * | 6/2013 | Zerhusen | A61G 7/0507 220/476 |
| 2016/0120329 | A1 * | 5/2016 | Zerhusen | A61G 7/0507 5/425 |

* cited by examiner

*Primary Examiner* — Robert G Santos

(74) *Attorney, Agent, or Firm* — Barnes & Thornburg LLP

(57) ABSTRACT

A siderail assembly comprises a siderail with a siderail body. The siderail body has a storage area integrated therein. The storage area has a bottom surface, at least one side surface, and an opening. The storage area is configured to removably retain at least one object therein.

14 Claims, 10 Drawing Sheets

SIDERAIL WITH STORAGE AREA

This Application claims priority to U.S. patent application Ser. No. 12/546,756 titled SIDERAIL WITH STORAGE AREA filed on Aug. 25, 2009, now U.S. Pat. No. 9,259,371, and U.S. Pat. No. 9,072,638 titled SIDERAIL WITH STORAGE AREA filed on Jul. 15, 2009, the contents of which are incorporated herein by reference.

BACKGROUND OF THE DISCLOSURE

This disclosure relates generally to person-support apparatuses. More particularly, but not exclusively, one illustrative embodiment relates to a person-support apparatus including a siderail with an integrated storage area.

People staying in hospitals can often bring personal belongings with them. The belongings can be collected by caregivers and stored until the person is discharged or the person requests an item. The belongings can be stored in a storage room that can include, for example, lockers, storage bins, drawers, and/or bags with identifying information, such as, the patient's room number, listed thereon, and/or a list of the items and/or bin, locker, or bag numbers and/or location put on the patient's medical chart. The people can also be provided with storage space for storing personal belongings or other objects in the room they are assigned to, for example, in various shelving units or other furniture storage areas, such as, drawers and/or closets. While various person-support apparatuses have been developed, there is still room for development. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a siderail with an indented portion that defines a storage area to place objects within.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout:

FIG. 9 is a perspective side view of the siderail of FIG. 1, including a storage area according to yet another embodiment of the current disclosure; and.

DETAILED DESCRIPTION OF THE DRAWINGS

Figure 1:
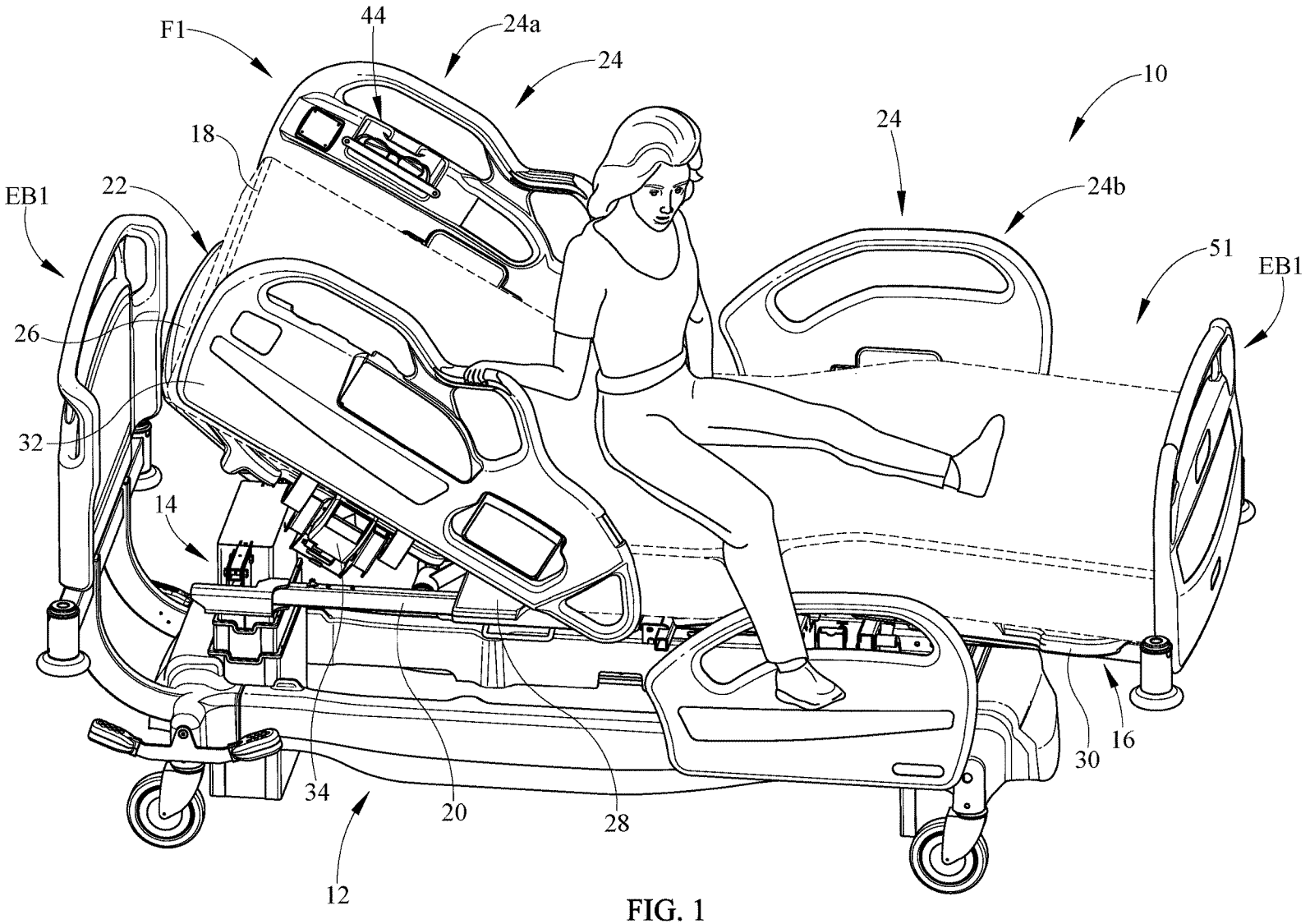
FIG. 1 is a perspective side view of a person-support apparatus with siderails coupled to a frame of the person-support apparatus according to an embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a siderail with an indented portion that defines a storage area to place objects within. Another illustrative embodiment can include a siderail with an indented portion that defines a storage area to place objects within and a retaining element to maintain the objects in the storage area.

Figure 2:
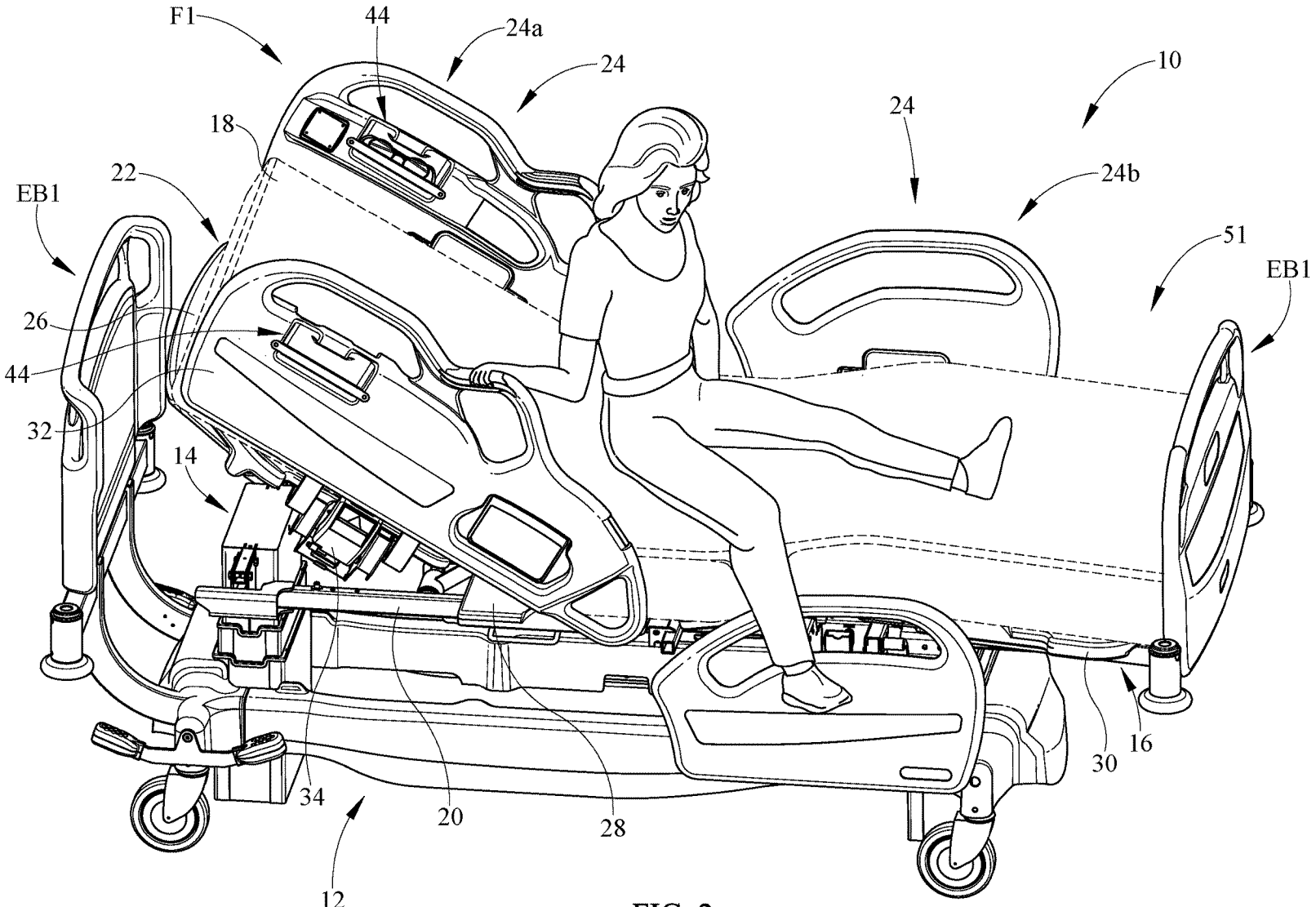
FIG. 2 is a perspective side view of a person-support apparatus with siderails coupled to a frame of the person-support apparatus according to another embodiment of the current disclosure.
Figure 3:
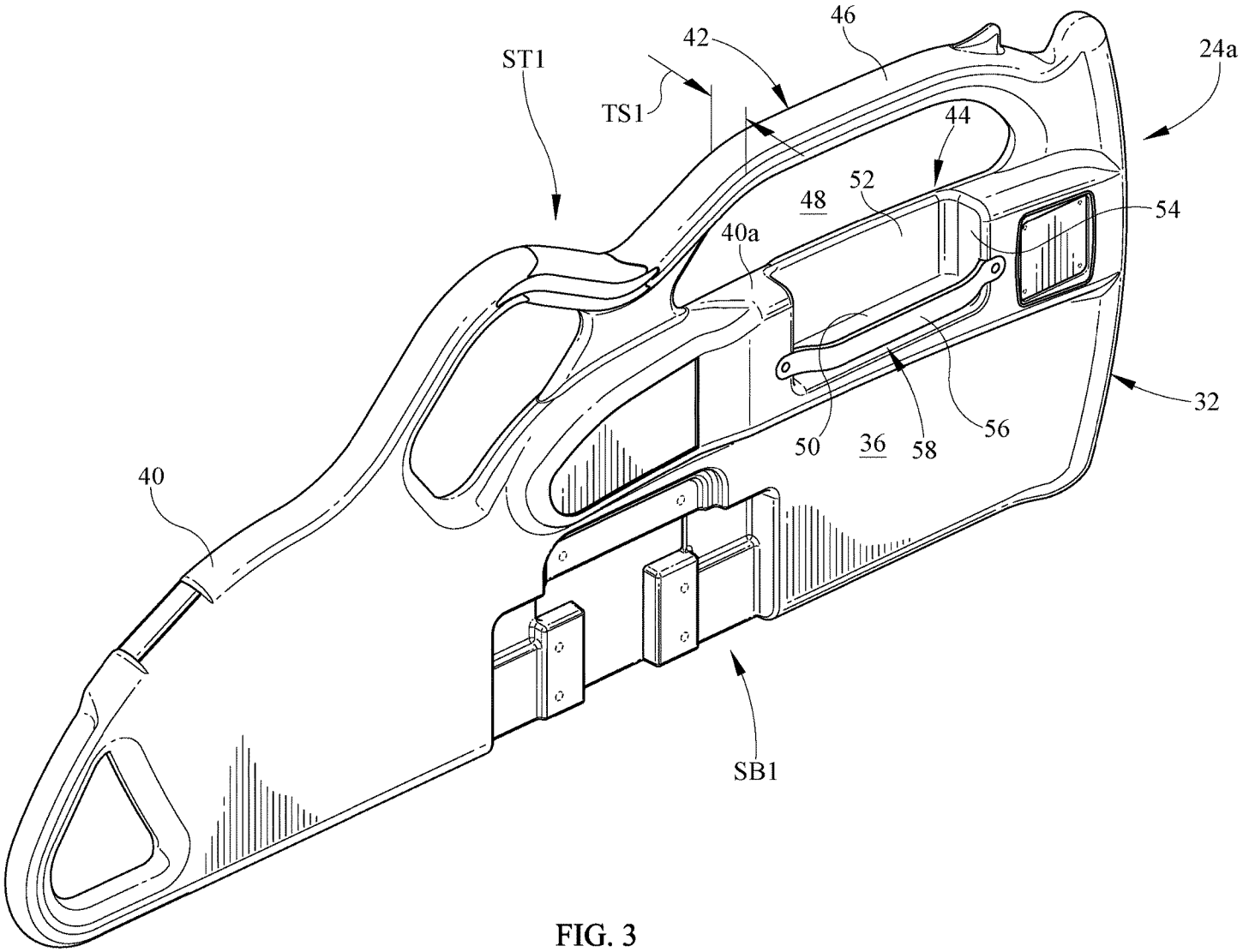
FIG. 3 is a perspective side view of a head siderail of FIG. 1, including a storage area on a first surface of a head siderail according to an embodiment of the current disclosure.

A person-support apparatus 10 according to one illustrative embodiment of the current disclosure is shown in FIGS. 1 and 2. The person-support apparatus 10 can have a first section F1 or head support section F1, where the head of a person can be positioned and a second section S1 or a foot support section S 1, where the feet of the person can be positioned. It should be appreciated that the first section F1 and the second section S1 can be portions of the same section. In one illustrative embodiment, the person-support apparatus 10 can be a hospital bed. It should be appreciated that the person-support apparatus 10 can also be a hospital stretcher or an operating table. The person-support apparatus 10 can include a lower frame 12 or base 12, a plurality of supports 14 coupled with the lower frame 12, and an upper frame 16 supported on the supports 14 above the lower frame 12. It should be appreciated that the supports 14 can be lift mechanisms 14 that can move the upper frame 16 with respect to the lower frame 12. It should also be appreciated that in one illustrative embodiment the person-support apparatus 10 can support a person-support surface 18 thereon.

The upper frame 16 can include an intermediate frame 20, a deck 22, siderails 24, and endboards EB1 as shown in FIGS. 1 and 2. The intermediate frame 20 can be coupled with the supports 14 and can support the deck 22 thereon as shown in FIGS. 1 and 2. The deck 22 can include a head portion 26, a seat portion 28, and a foot portion 30. The head portion 26, the seat portion 28, and the foot portion 30 can be movably coupled with each other and/or the intermediate frame 20.

The siderails 24 can include a siderail body 32 with a top portion ST1 and a bottom portion SB1, and a siderail linkage 34 as shown in FIGS. 1-9. In one illustrative embodiment, the siderails 24 can have a thickness TS1 of between about 1.5 inches and about 2 inches. It should be appreciated that the siderails 24 can have a thickness TS1 of less than 3 inches. The siderail linkage 34 can be coupled to the bottom portion SB1 of the siderail body 32 and can couple the siderails 24 to the deck 22 and/or the intermediate frame 20. In one illustrative embodiment, the siderails 24 can be coupled to the head portion 26 of the deck 22 (i.e., a first siderail 24*a* or a head siderail 24*a*) and/or coupled to the foot portion 30 of the deck 22 and/or the intermediate frame 20 (i.e., a second siderail 24*b* or a foot siderail 24*b*) as shown in FIG. 1. The siderail linkage 34 can be configured to can facilitate movement of the siderails 24 between a deployed/operation position and a storage position. In the deployed/operation position, as shown in FIG. 1, the siderails 24 can be present above the upper frame 16. In the storage position, the siderails 24 can be moved to a lower position below the deployed/operation position. It should be appreciated that the siderail linkage 34 can include a locking mechanism (not shown) that can maintain the siderails 24 in one of the operating and/or storage position when locked and can facilitate movement of the siderails 24 between the operating and storage position when unlocked.

The siderail body 32 can include a first surface 36, a second surface 38, a side surface 40 extending between the first surface 36 and the second surface 38, a grip portion 42, and a storage area 44 as shown in FIGS. 1-9. It should be appreciated that the siderail 24 can include a caregiver interface (not shown) that can be operable to control various functionalities of the person-support apparatus 10. The first surface 36 and the second surface 38 can be substantially parallel to one another. The first surface 36 can be oriented such that the first surface 36 faces towards a person supported on the person-support surface 18 and the second surface 38 can be oriented such that the second surface 38 faces away from the person supported on the person-support apparatus 10.

The grip portion 42 can be configured to be gripped by a person to assist the person with ingress/egress to/from the person support apparatus 10 as shown in FIGS. 1-9. In one illustrative embodiment, the grip portion 42 can be located along the top portion ST1 and can include a grip 46 and a grip opening 48 that can pass through the siderail body 32 and be configured to allow a person to wrap at least a portion of their fingers/hand around the grip 46 as shown in FIGS. 1-9. It should be appreciated that the grip portion 32 can include a grip opening cover (not shown) or net (not shown) that can be positioned within the grip opening 48 so that a person can partially wrap their fingers around the grip 46. In one illustrative embodiment, an upper portion of the grip opening 48 can define the bottom of the grip 46 and a lower portion of the grip opening 48 opposite the upper portion of the grip opening 48 can define a portion of the upper side surface 40*a*.

The storage area 44 can be configured to hold one or more objects as shown in FIGS. 1-10. It should be appreciated that the storage area 44 can include a portion that can protrude from the first surface 36 and/or the second surface 38 such that the total width of the siderail body 32 is less than about 3 inches. The storage area 44 can allow a person supported on the person-support apparatus 10 to store personal belongings PB1 within reach, which can reduce the time spent by the caregiver in fetching the personal belongings PB1 of the person. The one or more personal belongings PB1 can be or can include at least one of eye glasses, jewelry, dentures, photos, music playing devices, headphones, cellular phones, magazines, books, personal organizers, pens/pencils, tissues, or toiletries, or other personal electronic devices, personal belongings or objects. The one or more personal belongings can also include caregiver objects, such as, medical diagnosis equipment, medications, treatment or medication administering devices, syringes, bandages, recording materials, pens/pencils, or other caregiver devices, equipment, or materials.

Figure 10:
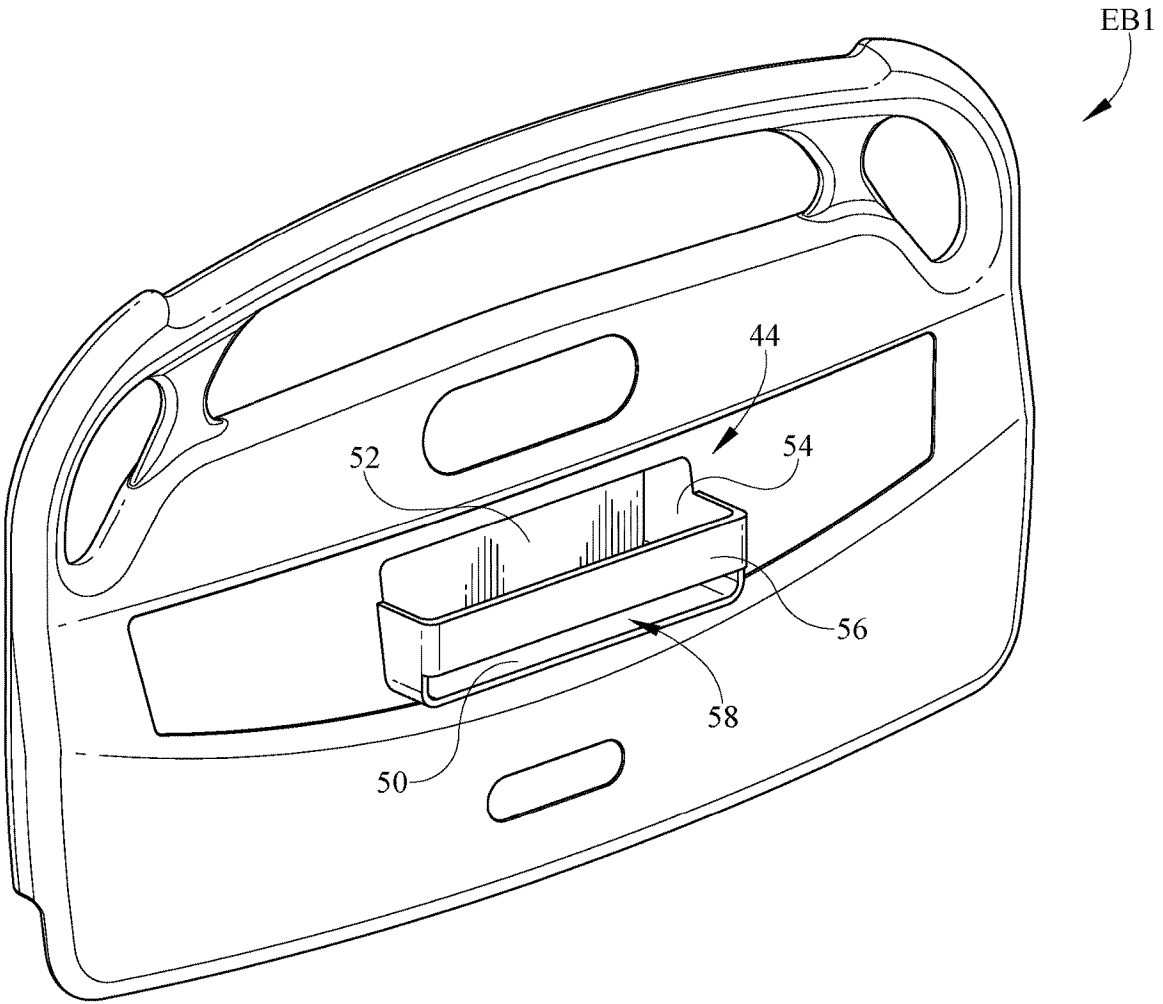
FIG. 10 is a perspective side view of an endboard of FIG. 1, including a storage area according to yet another embodiment of the current disclosure

In one illustrative embodiment, the storage area 44 can be recessed into the siderail body 32 and can include a storage area base 50, a storage area back 52, storage area sides 54, and a retaining element 56 as shown in FIGS. 1-9. In another illustrative embodiment, the storage area 44 can be recessed into an endboard EB1 as shown in FIG. 10. It should be appreciated that a portion of the storage area 44 can extend from the siderail body 32 and/or the endboard EB1. It should also be appreciated that at least a portion of the storage area back 52 and the storage area sides 54 can be transparent. It should further be appreciated that the storage area 44 can include an opening (not shown) between a portion of the storage area base 50 and a portion of at least one of the storage area back 52 and the storage area sides 54 to facilitate cleaning of the storage area 44.

Figure 4:
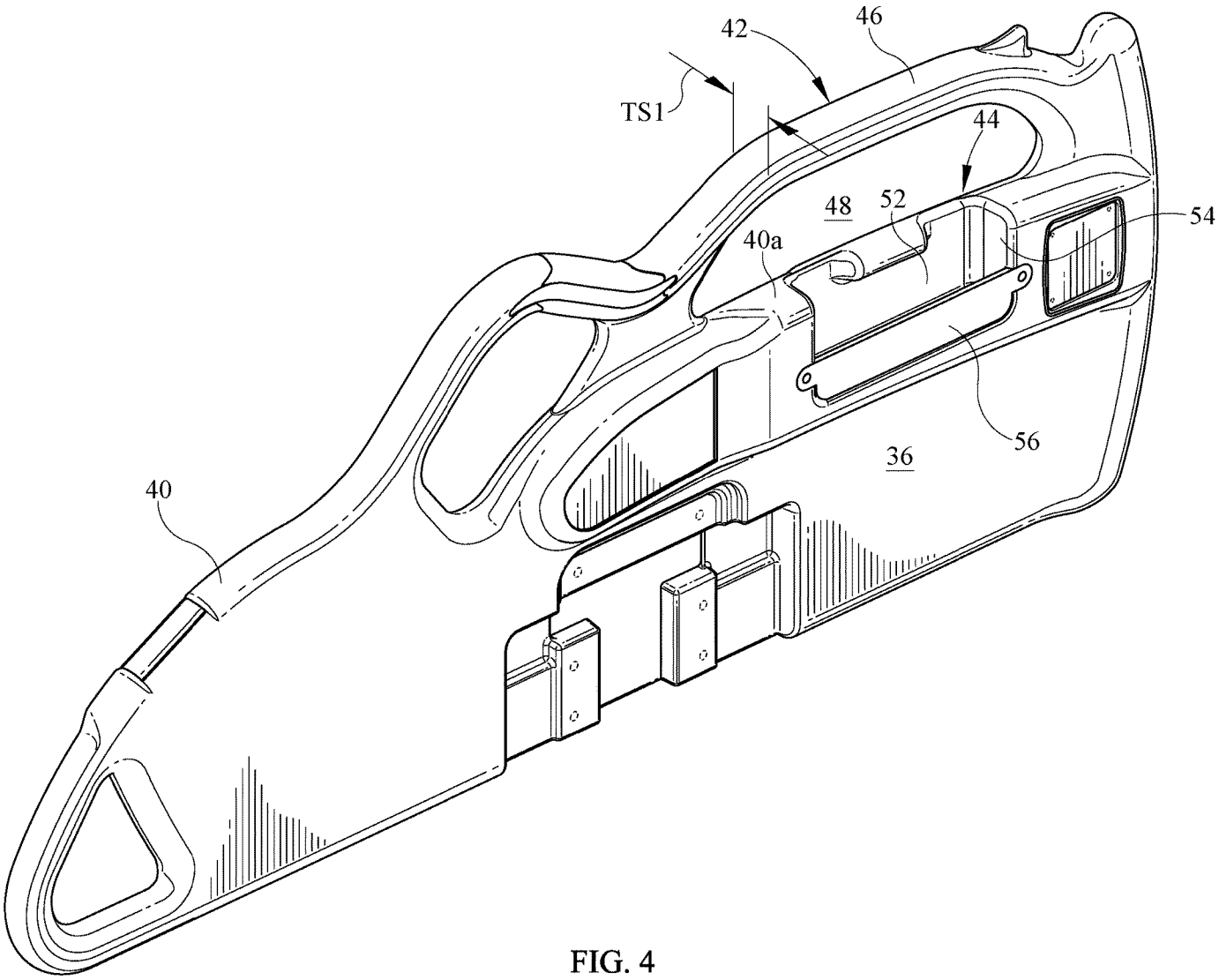
FIG. 4 is a perspective side view of a head siderail of FIG. 1, including a storage area on a second surface of the head siderail according to an embodiment of the current disclosure.
Figure 5:
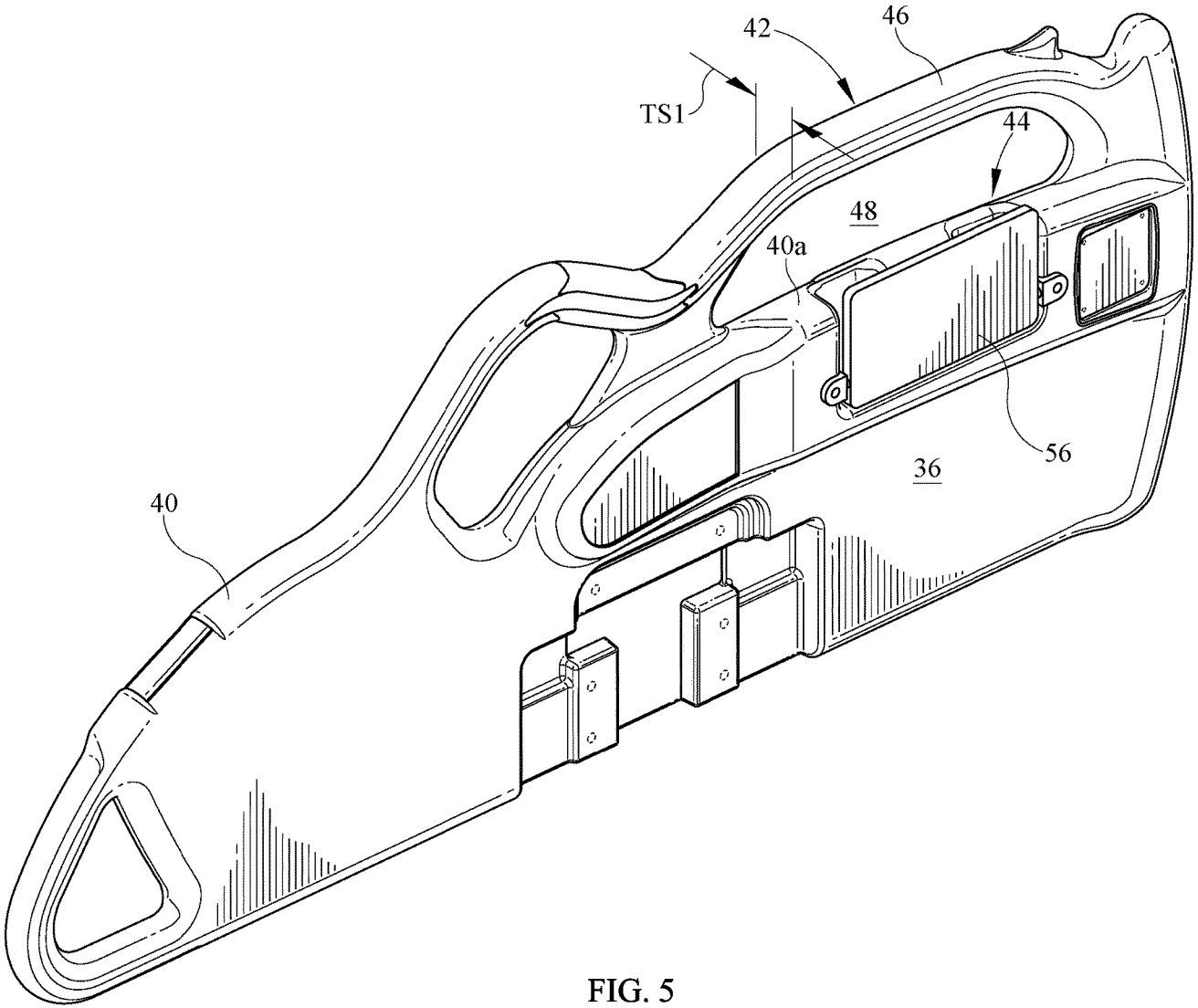
FIG. 5 is a perspective side view of a foot siderail of FIG. 1, including a storage area according to an embodiment of the current disclosure.

In one illustrative embodiment, the storage area back 52 can be recessed into the siderail body 32 between about 0.75 inches and about 1 inch from the first surface 36 of the siderail 24 and can have a width of between about 6.5 inches and about 7 inches and a height of between about 3.5 inches and 4 inches extending from the storage area base 50 to the upper side surface 40*a* as shown in FIGS. 1-3 & 5-7. In another illustrative embodiment the storage area 44 can be recessed into the siderail body 32 between about 0.75 inches and about 1 inch from the second surface 38 of the siderail 24 and can have a width of between about 6.5 inches and about 7 inches and a height of between about 3.5 inches and 4 inches extending from the storage area base 50 to the upper side surface 40*a* as shown in FIG. 4. In yet another illustrative embodiment, the storage area 44 can be recessed into the siderail body 32 between the first surface 36 and the second surface 38 such that the storage area sides 54 can be located between the first surface 36 and the second surface 38 and the storage area base 50 can be recessed from the upper side surface 40*a* between about 3.5 inches and about 4 inches as shown in FIG. 8. In still another embodiment, the storage area 44 can extend from the surface of the endboard EB1 about 12 inches and/or can be recessed into the endboard EB1 between about 0.75 inches and about 1 inch as shown in FIG. 10. It should be appreciated that the height, width, and depth of the storage area 44 can be greater than or less than the previously stated amounts. It should also be appreciated that the storage area 44 can be located on the head siderail 24*a*, the foot siderail 24*b*, and/or the endboards EB1 as shown in FIGS. 1-10. It should further be appreciated that more than the siderail body 32 can include more than one storage area 44 thereon.

Figure 6:
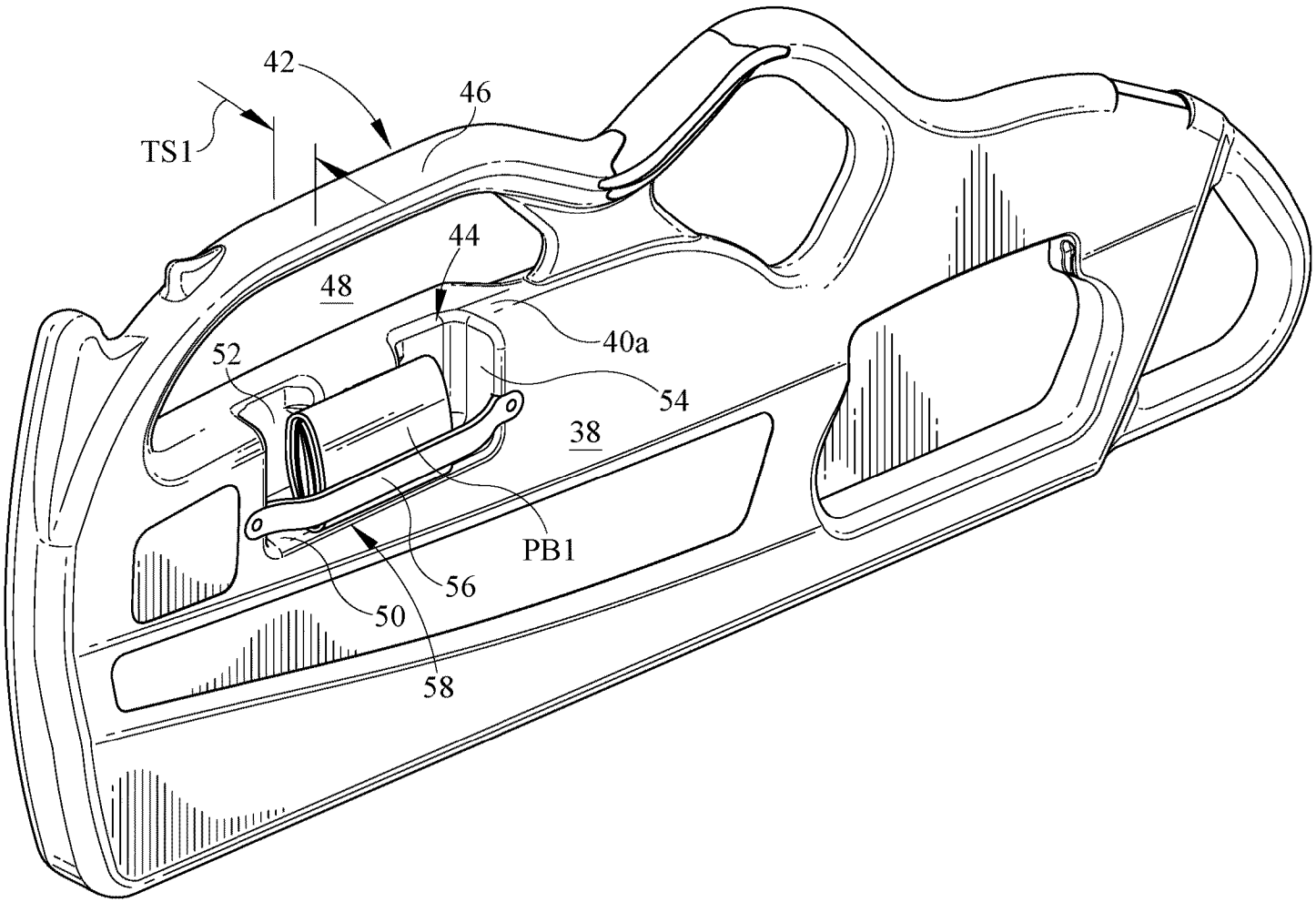
FIG. 6 is a perspective side view of the siderail of FIG. 1, including a storage area according to an embodiment of the current disclosure.
Figure 7:
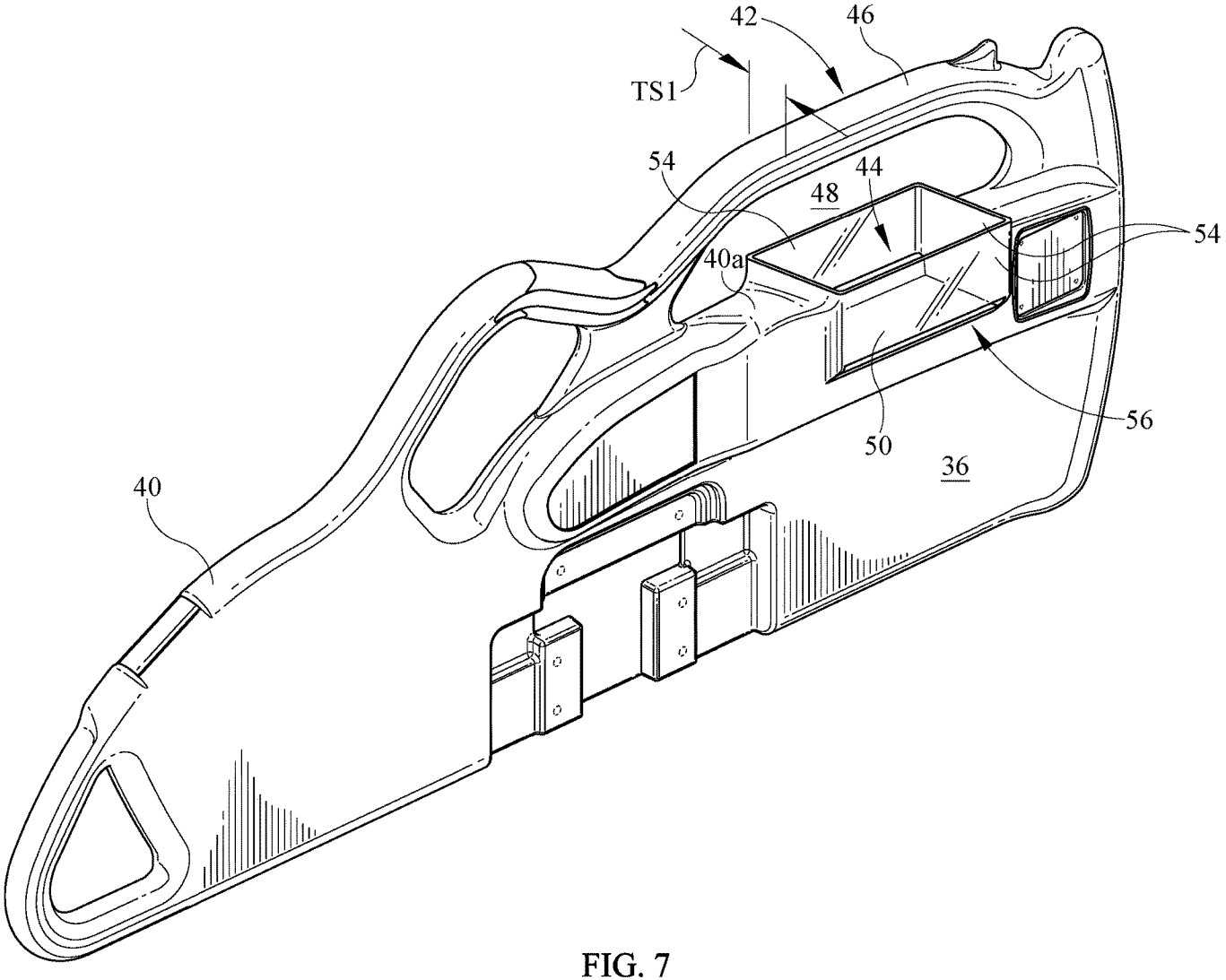
FIG. 7 is a perspective side view of the siderail of FIG. 1, including a storage area according to another embodiment of the current disclosure.
Figure 8:
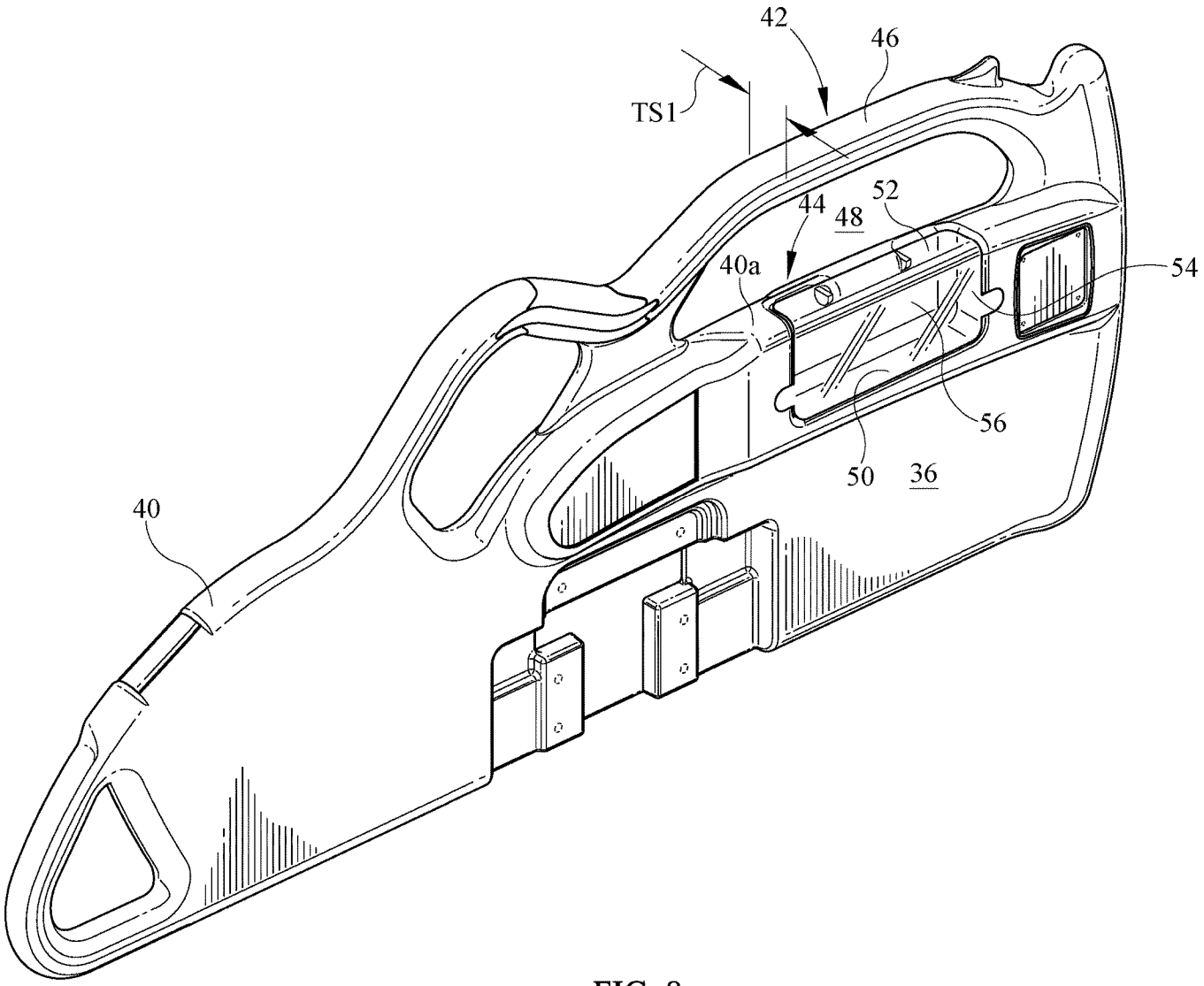
FIG. 8 is a perspective side view of the siderail of FIG. 1, including a storage area according to yet another embodiment of the current disclosure.
Figure 9:
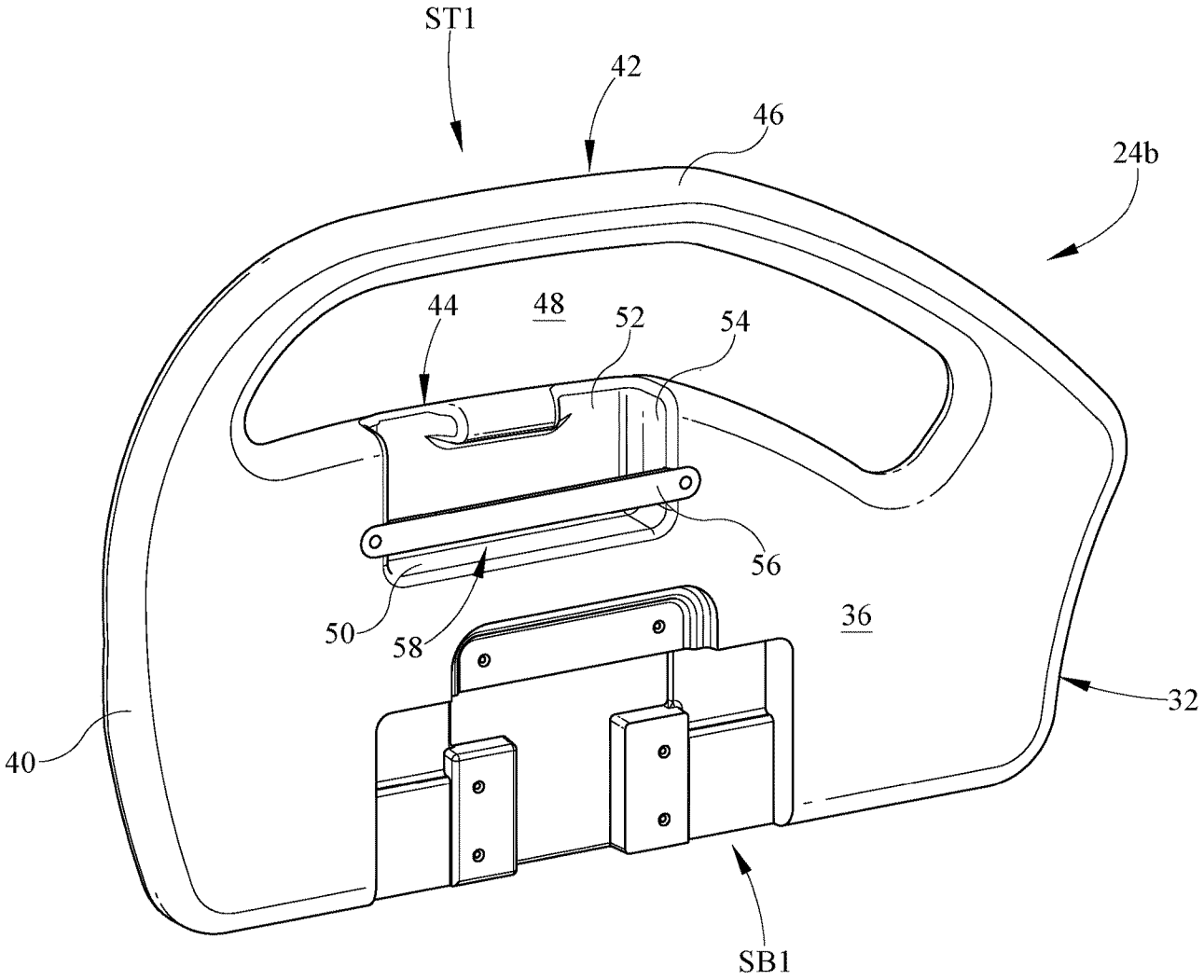

The retaining element 56 can be configured to retain personal belongings PB1 or other objects within the storage area 44 as shown in FIGS. 1-10. In one illustrative embodiment, the retaining element 56 can be or can include at least one of a strap or band, such as, a hook and loop fastener or an elastic band, as shown in FIGS. 2-5. In another illustrative embodiment, the retaining element 56 can be a plate as shown in FIG. 6. In yet another illustrative embodiment, the retaining element 56 can be a cover as shown in FIG. 7. It should be appreciated that at least a portion of the cover can be transparent. In still another illustrative embodiment, the retaining element 56 can be a protrusion or flange (not shown) that can be integrated into the storage area base 50 and/or the storage area sides 54. In other illustrative embodiments, the retaining element 56 can be a rod (not shown), a net, or other retaining mechanisms.

The retaining element 56 can be configured to extend across the width of the storage area 44 and couple with the first surface 36 of the siderail body 32 when the storage area 44 is located on the first surface 36, and couple with the second surface 38 of the siderail body 32 when the storage area 44 is located on the second surface 38 as shown in FIGS. 1-9. It should be appreciated that the retaining element can be integrated into the siderail body. In one illustrative embodiment, the retaining element 56 can extend across the storage area 44 such that there is a clearance space 58 between the storage area base 50 and the retaining element 56. The clearance space 58 can be configured to provide access to the storage area 44 for cleaning purposes.

Many other embodiments of the present disclosure are also envisioned. For example, a person-support apparatus comprises a frame and a siderail. The frame is configured to support a person thereon. The siderail is coupled to the frame. The siderail includes a siderail body with a first surface and a second surface. The first surface is oriented such that the first surface faces toward the frame and the second surface is oriented such that the second surface faces away from the frame. At least one of the first surface and the second surface has a storage area integrated therein. The storage area includes a bottom surface, at least one side surface, and an opening.

In another example a siderail assembly comprises a siderail with a siderail body. The siderail body has a storage area integrated therein. The storage area has a bottom surface, at least one side surface, and an opening. The storage area is configured to removably retain at least one object therein.

In yet another example a siderail assembly for a person-support apparatus comprises a siderail. The siderail includes a siderail body having a first surface, a second surface generally parallel to the first surface, and a third surface extending between about the first surface and about the second surface. The first surface and the second surface are spaced apart a first distance. The siderail body includes a storage area having a bottom surface, at least one side surface, and an opening. The storage area is integrated into the siderail body such that the storage area is at least one of recessed from and extending from at least one of the first surface, the second surface, and the third surface a second distance.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A perimeter panel assembly for use with a person support apparatus, comprising:

a perimeter panel including a body;

a storage area formed in the body and including a bottom surface, at least one side surface extending from the bottom surface, and an opening; and a retaining element coupled to the body and extending across the opening, the retaining element being configured to cooperate with the storage area to removably retain at least one object within the storage area, wherein the retaining element is elastic.

2. The perimeter panel assembly of claim 1, wherein the retaining element includes a longitudinally extending member.

3. The perimeter panel assembly of claim 1, wherein the retaining element is spaced apart from the bottom surface a predetermined distance to define a second opening.

4. The perimeter panel assembly of claim 1, wherein the storage area is recessed from a surface of the body.

5. The perimeter panel assembly of claim 1, wherein the storage area is configured to receive and removably retain at least one personal belonging of a person supported on the person support apparatus.

6. The perimeter panel assembly of claim 1, wherein the storage area is configured to receive and removably retain at least one caregiver object.

7. The perimeter panel assembly of claim 1, wherein the retaining element is secured to a surface of the body on opposite sides of the opening.

8. A siderail for use with a person support apparatus, comprising:

a siderail assembly including a body;

a storage area formed in the body and including a bottom surface, at least one side surface extending from the bottom surface, and an opening; and a retaining element coupled to the body and extending across the opening, the retaining element being configured to cooperate with the storage area to removably retain at least one object within the storage area, wherein the retaining element is elastic.

9. The siderail of claim 8, wherein the retaining element includes a longitudinally extending member.

10. The siderail of claim 8, wherein the retaining element is spaced apart from the bottom surface a predetermined distance to define a second opening.

11. The siderail of claim 8, wherein the storage area is recessed from a surface of the body.

12. The siderail of claim 8 wherein the storage area is configured to receive and removably retain at least one personal belonging of a person supported on the person support apparatus.

13. The siderail of claim 8, wherein the storage area is configured to receive and removably retain at least one caregiver object.

14. The perimeter panel assembly of claim 8, wherein the retaining element is secured to a surface of the body on opposite sides of the opening.

* * * * *